US005174010A

United States Patent [19]

Asselin

[11] Patent Number: 5,174,010

[45] Date of Patent: Dec. 29, 1992

[54] BREAKER BLADE AND WIRE PULLER FOR AUTOMATIC KRAFT BALE DEWIRING MACHINE

[75] Inventor: Michael C. Asselin, Sartell, Minn.

[73] Assignee: Champion International Corporation, Stamford, Conn.

[21] Appl. No.: 790,915

[22] Filed: Nov. 13, 1991

[51] Int. Cl.[5] ..... B23P 19/00

[52] U.S. Cl. ..... 29/564.3; 29/426.4; 83/909; 225/93

[58] Field of Search ..... 225/93; 29/426.4, 564.3; 83/909, 924, 160, 651

[56] References Cited

U.S. PATENT DOCUMENTS 3,484,940 12/1969 Zell, Jr. ..... 83/924 X
4,841,619 6/1989 Theriault ..... 29/426.4 X
5,079,826 1/1992 Ercums et al. ..... 29/564.3

*Primary Examiner*—Eugenia Jones
*Attorney, Agent, or Firm*—Evelyn M. Sommer

[57] ABSTRACT

A wire breaker blade and a wire puller member are provided for an automatic kraft paper bale dewiring machine for respectively breaking and removing a plurality of baling wires from a bale of kraft paper pulp. The wire breaker blade includes a hook-shaped wire cutting notch having an arcuate cutting edge with an inwardly extending protrusion formed therein for engaging and retaining a plurality of baling wires until fracture of the baling wires occurs. The wire puller member includes a hook-shaped wire pulling notch having an arcuate pulling edge with a radially inwardly extending protrusion form therein for engaging and retaining a plurality of fractured baling wires until the baling wires are completely removed from the kraft paper bale.

8 Claims, 3 Drawing Sheets

BREAKER BLADE AND WIRE PULLER FOR AUTOMATIC KRAFT BALE DEWIRING MACHINE

BACKGROUND OF THE INVENTION

Kraft paper pulp is used to make a host of paper products including newsprint, catalog paper and grocery bags. The unprocessed kraft paper pulp which is used to make these products is often transported to a production facility in standard rectangular bales having a height in the range of 15" to 19", a width of between 24" to 36" and a length in the range of 24" to 36". The majority of unprocessed kraft paper bales are tightly wrapped with at least two transverse baling wires and anywhere from one to four longitudinal baling wires. These baling wires which may be round or oval in cross-sectional shape generally have a size in the range of 12 to 14 AWG.

It is essential for the safe and efficient operation of a paper production line that the baling wires which are used for wrapping kraft paper pulp bales be completely removed prior to introducing the unprocessed kraft paper into a production line. In the past, the removal of baling wires from bales of kraft paper has been accomplished manually, with the use of hand held wire cutters. However, the repetitive clenching hand motion that is associated with the continuous manual clipping and removal of baling wires from kraft paper bales has been known to cause carpel tunnel syndrome, a condition which is characterized by burning, aching, and numbness in the hand and wrist. Carpal tunnel syndrome is one of the most common occupational hazards in the pulp and paper industry. In addition, the manual removal of baling wires can often cause accidents when the baling wires suddenly snap free after being clipped. With these problems in mind, improvements have been made in the area of bale wire removal. In particular, automatic kraft paper bale wire removal systems have been introduced into paper production plants so as to improve the health and safety of factory workers in the pulp and paper industry and to ensure the efficient operation of paper production equipment.

A prior art automatic kraft bale dewiring system is manufactured by Lamb Canada Ltd. of Montreal, Quebec. The operational steps of Lamb's kraft bale dewiring system are illustrated schematically in FIGS. 1*a*–1*d* wherein the dewiring system is designated generally by reference numeral 10. The prior art kraft bale dewiring system 10 comprises a dewiring machine 12 having a remotely operated conveyor turntable 14 on which a bale of kraft paper 16 is loaded from a forklift truck into the dewiring system 10 with the longitudinal baling wires 18 running parallel to the flow of the bale 16 through the dewiring machine 12. Referring to FIG. 1*b*, the kraft paper bale 16 is clamped on its sides by opposed side clamps 20 and 22 and at its top by clamp 24 so as to firmly hold the bale 16 on the conveyor turntable 14 during the wire cutting operation. Referring to FIG. 1*c*, subsequently, a wire breaker blade 24, which travels beneath the kraft paper bale 16, engages and breaks each longitudinal baling wire 18 on the bale 16. Referring to FIG. 1*d*, thereafter, the bale clamps 20, 22 and 24 are retracted and a plurality of lift pegs 26 which are disposed beneath the bale 16 are actuated so as to raise the bale 16 off of the conveyor turntable 14. At such a time, a wire puller member 28, which travels across the top of the kraft paper bale 16, hooks each broken longitudinal baling wire 18 in succession so as to pull each broken baling wire 18 off of the bale 16 and out of the path of the conveyor 14.

Upon completing the wire cutting and removal operation. the kraft paper bale 16 is rotated on the conveyor 14 and the cutting and removal operation is repeated to fracture and remove the transverse baling wires from the kraft paper bale 16. Some prior art dewiring systems initially position the bale 16 so that the blade 26 and the wire puller 28 move diagonal to both the longitudinal and transverse wires so that only one diagonal movement of the breaker blade 26 and one diagonal movement of the puller 28 are required for each bale. Once the kraft paper bale 16 is completely dewired it is conveyed into the paper production line for conversion into paper products.

The prior art breaker blade 24 is illustrated in FIG. 2. Breaker blade 24 comprises a mounting portion 30 and a cutting portion 32. More particularly, mounting portion 30 includes a lower mounting flange 34 with opposed side mounting notches 36 and 38. The mounting portion is fashioned for removable installation in the dewiring machine 12. The cutting portion 32 of the prior art breaker blade 24 includes a leading edge 40 at the forward end thereof and a trailing edge 42 at the rearward end thereof. A ramped upper edge 44 having an angle of incline $\alpha$ extends from the leading edge 40 to a generally rectangular cutting notch 46. More particularly, the generally rectangular cutting notch 46 extends downwardly into the cutting portion 32 of the breaker blade 24. The breaker blade 24 further includes a single flat guide surface 48 disposed intermediate the rectangular cutting notch 46 and the rearward trailing edge 42 of the breaker blade 24 which is intended to maintain the breaker blade 24 in close proximity to the bottom of the bale 16 during cutting operation.

There are several deficiencies inherent in the design of the prior art breaker blade member 24. First, although the flat guide surface 48 is capable of maintaining position stability of the cutting portion 32 of breaker blade 24 during normal operating conditions, the blade 24 may encounter shocks or vibrations while traveling along its intended cutting path which could cause the prior art breaker blade 24 to shift or rock about its longitudinal axis. Consequently, the cutting portion 32 of the breaker blade 24 may not remain in close proximity to the bottom of the bale 16 and may fail to positively engage certain baling wires in the rectangular cutting notch 46.

Second, under certain abnormal operating conditions during which the breaker blade 24 encounters shocks or vibrations, baling wires 18 which may be engaged in the rectangular cutting notch 46 can slip out of the cutting notch 46 prior to being fractured.

Third, as a plurality of baling wires are engaged in succession, a leading baling wire may be urged out of the rectangular cutting notch 46 by trailing baling wires subsequently engaged in the cutting notch 46. As a consequence of the breaker blade failing to engage or retain certain baling wires, a kraft paper bale may exit the dewiring machine 12 and enter a paper production line with certain baling wires intact which could cause severe damage to expensive production machinery.

Therefore, it is an object of the subject invention to provide a new and improved breaker blade member for an automatic kraft bale dewiring machine having a cutting notch which is particularly adapted to securely engage and retain, until fracture, a plurality of baling wires.

It is another object of the subject invention to provide a new and improved breaker blade member for an automatic kraft bale dewiring machine having a plurality of flat guide surfaces to maintain position stability of the blade and maintain the blade in close proximity to the bottom of a kraft paper bale during normal and abnormal operating conditions.

The prior art wire puller member 28 is illustrated in FIG. 3. The wire puller member 28 basically comprises an engaging portion 50 and a mounting portion 52. More particularly, the mounting portion 52 includes a pair of spaced apart mounting apertures 54 and 56 extending therethrough for mounting the puller blade 28 to the dewiring machine 12. The engaging portion 50 of the prior art puller member 28 includes an arcuate forward leading edge 58, an intermediate ramped edge 60 and a rearward trailing edge 62. The prior art puller member 28 further includes a pair of spaced apart generally parallelogram shaped puller notches 64 and 66 which extend inwardly into the engaging portion 50 thereof.

There are several deficiencies inherent in the design of the prior art wire puller member 28. First, under certain operating conditions in which the puller member 28 encounters shocks or vibrations the puller notches 64 and 66 may fail to securely engage and retain one or more baling wires during a wire removal operation.

Second, as the puller member engages a plurality of baling wires in succession, a trailing baling wire may urge a leading baling wire out of one of the puller notches 64 and 66. Consequently, the kraft paper bale 16 may exit the dewiring machine 12 to be introduced into the paper production line with baling wires still wrapped around the bale 16 which could cause severe damage to production equipment.

Third, to fabricate the prior art puller member 28 several complex machining steps are necessarily required including intricate cutting procedures. In addition, the prior art puller member 28 comprises a substantial amount of plate material and thus is costly to manufacture.

Therefore, it is a another object of the subject invention to provide a new and improved wire puller member for an automatic kraft bale dewiring machine having a wire pulling notch which is particularly adapted to securely engage and retain one or more baling wires during a wire removal operation.

It is a further object of the subject invention to provide a new and improved wire puller member for an automatic kraft bale dewiring machine which is inexpensive to manufacture.

SUMMARY OF THE INVENTION

The subject invention is directed to a new and improved wire breaker blade member and a new and improved wire puller member for an automatic kraft bale dewiring machine which is commonly employed in the pulp and paper industry for removing one or more baling wires from a bale of kraft paper pulp.

The new and improved breaker blade member of the subject invention comprises a substantially planar plate body having opposed lateral faces, a lower mounting portion for attachment to an automatic kraft bale dewiring machine and an upper cutting portion having a cutting notch for breaking one or more baling wires in succession. In particular, the breaker blade includes a hook-shaped cutting notch which extends inwardly into the cutting portion of the blade member. The hook-shaped cutting notch is provided with a radially inwardly extending protrusion which is particularly adapted to securely engage and retain one or more baling wires within the cutting notch until fracture of the baling wires occurs.

An extremely desirable attribute of the hook-shaped cutting notch of the breaker blade member of the subject invention is that the cutting surface within the cutting notch may be sharpened by reboring the hook-shaped cutting notch to a slightly larger horizontal dimension. An additional desirable attribute of the breaker blade member of the subject invention is that a flat guide surface is provided adjacent to either end of the hook-shaped cutting notch for ensuring that the breaker blade member remains in close proximity to the bottom of the kraft paper bale during normal cutting operations and under conditions of shock or vibration.

The new and improved wire puller member of the subject invention comprises a substantially planar plate body having opposed lateral faces, an upper mounting portion which includes a pair of apertures for receiving fasteners for attachment to an automatic kraft bale dewiring machine and a bale wire engaging portion having a puller notch for securely engaging and removing one or more baling wires in succession from a bale of kraft paper after they have been fractured by the breaker blade member. In particular, the wire puller member of the subject invention includes a hook-shaped puller notch which extends inwardly into the engaging portion thereof. The hook-shaped puller notch includes an inwardly extending protrusion which is particularly adapted to securely retain one or more baling wires within the puller notch until they are pulled clearly away from the bale and out of the path of the conveyor. Additionally, the wire puller member of the subject invention can be manufactured using only a few simple machining steps and a rather small piece of plate material and is thus extremely inexpensive to fabricate.

Common to both the breaker blade member and the wire puller member of the subject invention is the structural configuration of the hook-shaped notch provided in the working portion of each member. Since both of the members are provided with a similar work performing element the fabrication of both members may be accomplished efficiently. Moreover, both members will necessarily require similar machining steps.

DETAILED DESCRIPTION OF THE PREFERRED EMBODIMENT

Figure 1A:
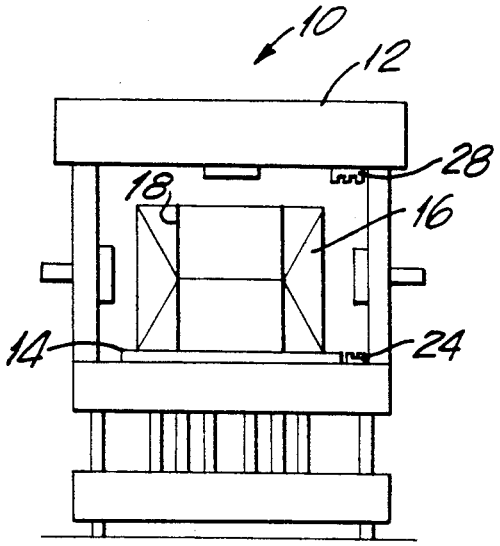
PRIOR ART FIG. 1a
FIG. 1*a* is a front elevational view of an automatic kraft bale dewiring machine in an inoperative state.
Figure 1B:
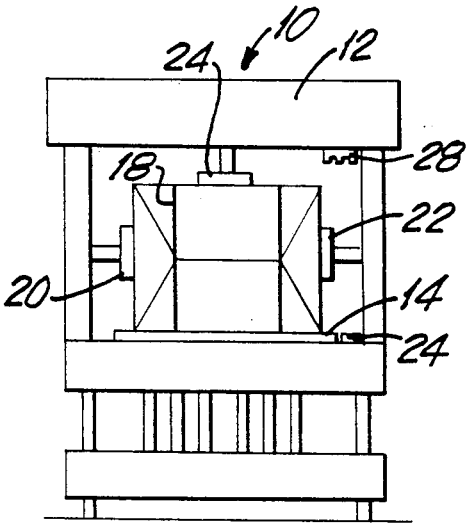
PRIOR ART FIG. 1b
FIG. 1*b* is a front elevational view of an automatic craft bale dewiring machine in an operative state prior to a dewiring operation.
Figure 1C:
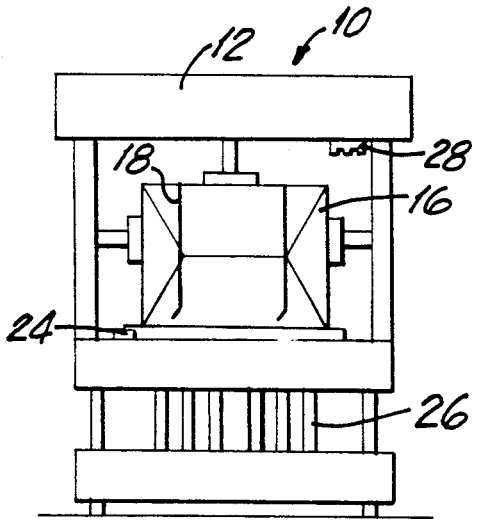
PRIOR ART FIG. 1c
FIG. 1*c* is a front elevational view of an automatic kraft bale dewiring machine during the wire cutting phase of its operation.
Figure 1D:
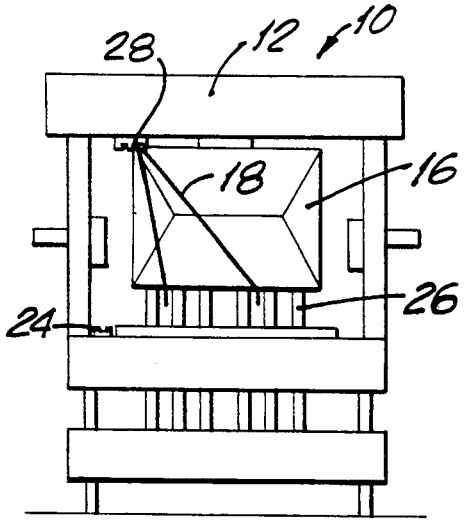
PRIOR ART FIG. 1d
FIG. 1*d* is a front elevational view of an automatic kraft bale dewiring machine during the wire pulling and removal phase of its operation.
Figure 3:
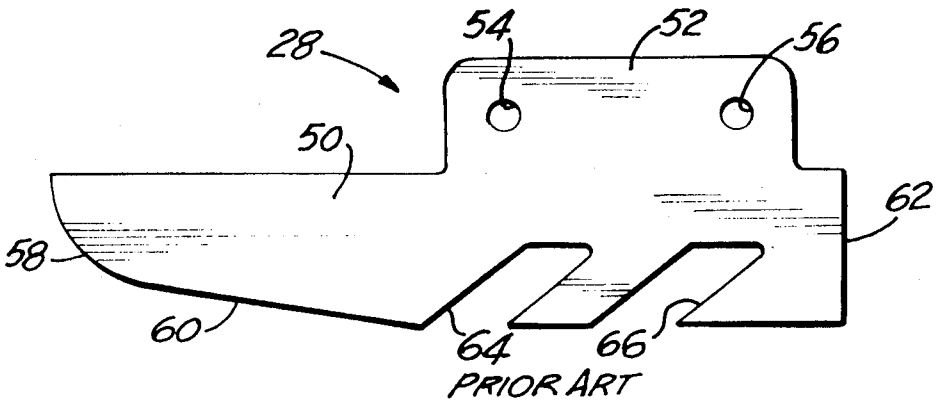
PRIOR ART FIG.3
FIG. 3 is a front elevational view of the prior art wire puller member.
Figure 2:
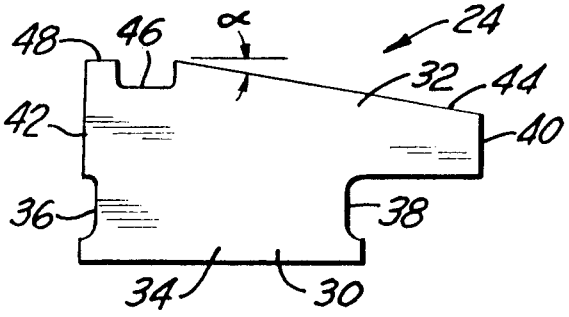
PRIOR ART FIG.2
FIG. 2 is a front elevational view of the prior art breaker blade member.

The new and improved breaker blade member and the new and improved wire puller member of the subject invention are illustrated in FIGS. 4–8 and are designated generally by reference numerals 100 and 200, respectively. The breaker blade member 100 and the wire puller member 200 of the subject invention are employed on an automated kraft bale dewiring system which is used in the pulp and paper industry to remove baling wires from a bale of kraft paper pulp prior to introducing the paper pulp into a production line for conversion into paper products. The prior art kraft bale dewiring system 10 illustrated schematically in FIGS. 1*a*–1*d* has been described herein above.

Figure 5:
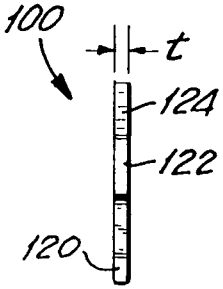
FIG. 5 is a side elevational view of the breaker blade member of the subject invention.
Figure 4:
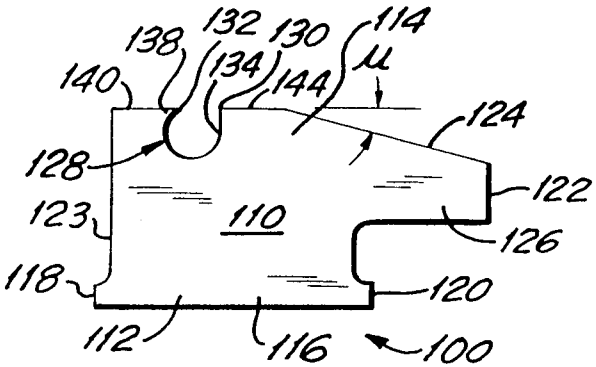
FIG. 4 is a front elevational view of the breaker blade member of the subject invention.
Figure 8A:
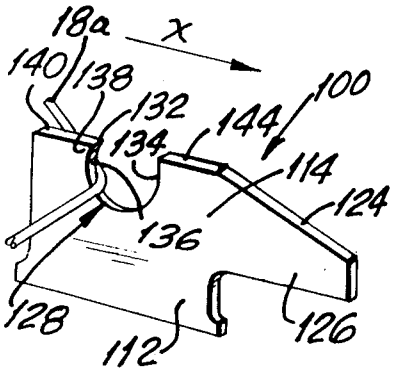
FIGS. 8*a*–8*d* are perspective views of the cutting blade member of the subject invention with baling wires securely retained and engaged therein.
Figure 8B:
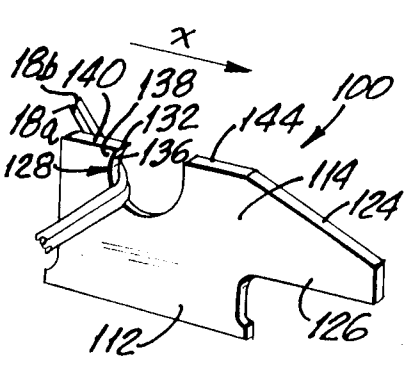
Figure 8C:
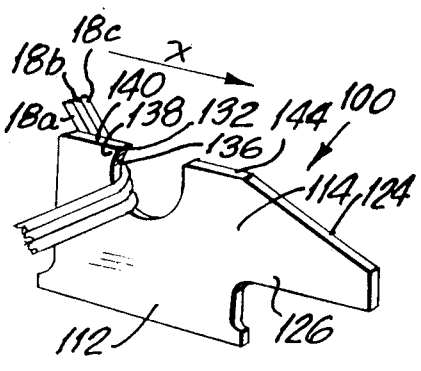
Figure 8D:
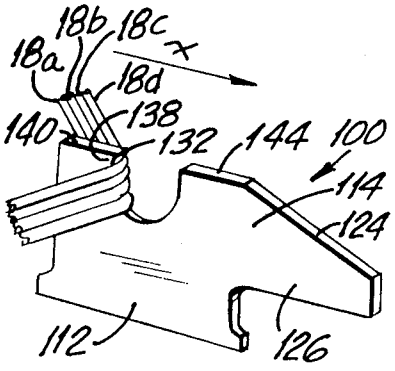
Figure 9D:
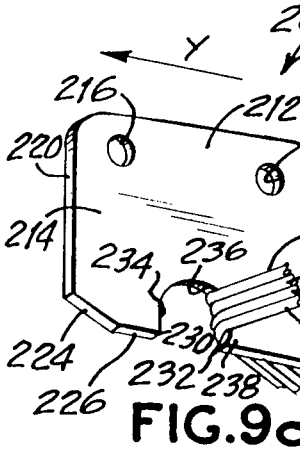
FIGS. 9*a*–9*d* are perspective views of the wire puller member of the subject invention with baling wires securely engaged and retained therein.
Figure 9C:
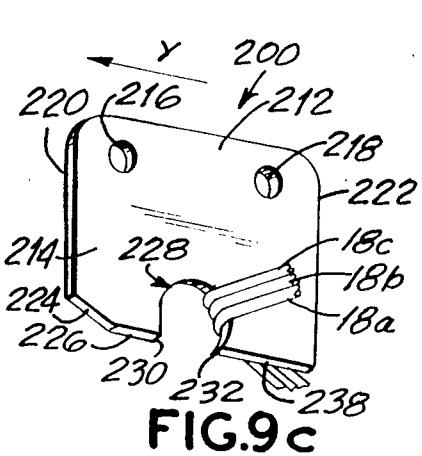
Figure 9B:
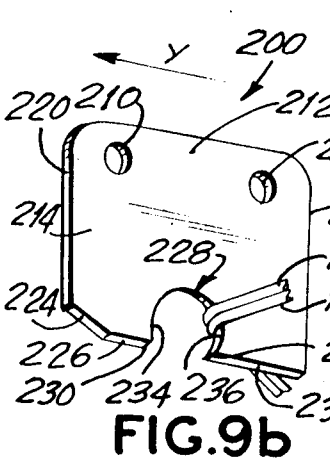
Figure 9A:
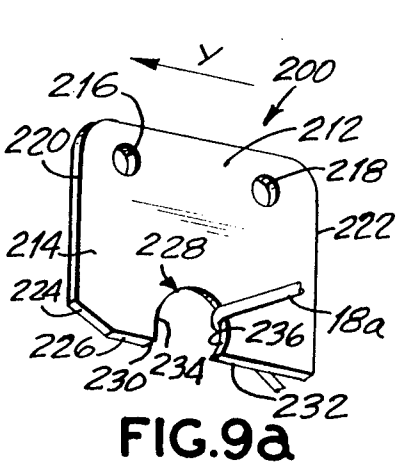

Turning to FIGS. 4 and 5, the breaker blade member 100 of the subject invention comprises an elevated substantially planar blade body 110 having a thickness "t". The blade body 110 includes a lower mounting portion 112 and an upper cutting portion 114. The lower mounting portion 112 is provided with a flange 116 having a pair of opposed depending retaining feet 118 and 120. Mounting portion 112 is dimensioned for detachable engagement with the dewiring machine 12. The upper cutting portion 114 of the blade body 110 of the breaker blade member 100 includes a forward edge 122, a rearward edge 123 and a ramped guiding surface 124 having an angle of incline designated by the symbol "$\mu$". The forward leading edge 122 and the ramped guiding surface 124 define a nose portion 126 which initially contacts and guides a baling wire 18 towards a hook-shaped cutting notch 128 during wire cutting operations.

The hook-shaped cutting notch 128 having a leading end 130 and a trailing end 132, and extends downwardly into the planar blade body 110 of the blade member 100. The cutting notch 128 includes a straight edge 134 extending downwardly from the leading end 130, and an arcuate cutting edge 136 extending circumferentially from the straight edge 134 upwardly toward the trailing end 132 thereof. The arcuate cutting edge 136 extends through an arc of approximately 225°. The hook-shaped cutting notch 128 is further provided with an inwardly extending protrusion 138 disposed at the trailing end 132 of the cutting notch 128. The protrusion 138 functions to securely engage and retain a plurality of baling wires 18 within the cutting notch 128 until fracture of the baling wires occurs.

The hook-shaped cutting notch 128 of the breaker blade member 100 of the subject invention may become dulled after repeated cutting operations. However, the hook-shaped cutting notch 128 may be easily sharpened such that the breaker blade member 100 may be repeatedly reused. More particularly, the hook-shaped cutting notch 128 may be rebored at a location slightly closer to the rear edge 123. This effectively creates a new protrusion rearward of the illustrated protrusion 138. As a result of reboring the hook-shaped cutting notch 128 the wire retaining function of the inwardly extending protrusion is maintained.

The new and improved breaker blade member of the subject invention further comprises a first guide surface 140 which is disposed parallel to the longitudinal axis of the blade body 110 and extends from the rearward edge 123 of cutting portion 114 to the trailing end 132 of the cutting notch 128. A second guide surface 144 is also disposed parallel to the longitudinal axis of the blade body 110 and extends from the leading end 130 of the cutting notch 128 to the rearward edge of the ramped guide surface 124. The spaced apart guide surfaces 140 and 144 function to ensure that the cutting portion 114 of the breaker blade member 100 remains in close proximity to the bottom of the kraft paper bale 16 during normal operating conditions and when the breaker blade encounters shocks or vibrations which may tend to urge the breaker blade 100 to shift about its longitudinal axis. The pair of spaced apart guide surfaces 140 and 144 prohibits the cutting blade 100 from shifting and thus the cutting notch 128 remains in a position wherein total bale wiring engagement is ensured.

Turning to FIGS. 8*a*–8*d*, in operation, the blade member 100 of the subject invention engages in succession a plurality of baling wires 18*a*–18*d* in the hook-shaped cutting notch 128 while traveling in the direction of indicator arrow "x". More particularly, as the blade member 100 travels in the direction of indicator arrow "x" it first encounters a baling wire 18*a* which is engaged and retained in the cutting notch 128 against the arcuate cutting edge 136. Subsequently, the blade member 100 encounters a second baling wire 18*b* which also is engaged and retained in the cutting notch 128. Consequently, upon entering the cutting notch 128, baling wire 18*b* urges baling wire 18*a* towards the inwardly extending protrusion 138. Similarly, upon engaging and retaining a third baling wire 18*c* and possibly a fourth baling wire 18*d* in cutting notch 128, baling wire 18*a* is urged closer to the trailing end 132 of the cutting notch 128. However, the inwardly extending protrusion 138 functions to securely retain all of the baling wires 18*a*–18*d* within the cutting notch 128 until such a time as fracture occurs when each of the baling wires 18*a*–18*d* reach their ultimate tensile strength and break.

Figure 7:
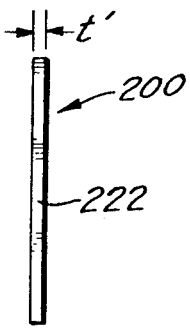
FIG. 7 is a side elevational view of the wire puller member of the subject invention.
Figure 6:
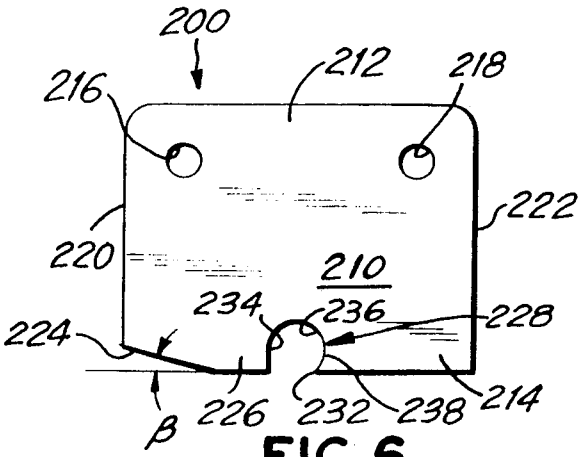
FIG. 6 is a front elevational view of the wire puller member of the subject invention.

Turning to FIGS. 6 and 7, the wire puller member 200 of the subject invention comprises a substantially rectangular planar plate body 210 having a thickness "t'". The plate body 210 includes an upper mounting portion 212 and a lower wire pulling portion 214. The upper mounting portion 212 includes a pair of spaced apart circular mounting apertures 216 and 218 which are provided for receiving fasteners to mount the puller member 200 to the automatic dewiring machine 12. The lower wire pulling portion 214 is defined by a forward edge 220 and an opposed rearward edge 222. A ramped wire guide surface 224 extends angularly from the forward leading edge 220 at an angle of incline designated by the symbol "$\beta$". Extending from the ramped wire guide surface is a flat surface 226 which extends to a hook-shaped wire puller notch 228.

The hook-shaped wire puller notch 228 has a leading end 230 and a trailing end 232 and extends upwardly into the planar body 210 of the wire puller member 200. The hook-shaped wire puller notch 228 includes a straight edge 234 extending upwardly from the leading end 230 and an arcuate edge 236 extending circumferentially from the straight edge 234 to the trailing end 232 of the puller notch 228. The arcuate edge 236 extends through an arc of approximately 225°. The puller notch 228 is further provided with a radially inwardly extending protrusion 238 disposed at the trailing end 232 of puller notch 228. The protrusion 238 functions to securely engage and retain a plurality of fractured baling wires 18 in the puller notch 228 until the baling wires are pulled away from the kraft paper bale 16 and out of the path of the conveyor 14.

Turning to FIGS. 9*a*–9*d*, in operation the wire puller member 200 of the subject invention engages in succession a plurality of fractured baling wires 18*a*–18*d* in the hook-shaped wire puller notch 228 while traveling in the direction of indicator arrow "y". More particularly, as the wire puller member 200 travels in the direction of indicator arrow "y" it first encounters a fractured baling wire 18*a* which is engaged and retained in the arcuate puller notch 228 against the arcuate edge 236. Subsequently, the puller member 200 encounters a second broken baling wire 18*b* which is engaged and retained in the wire puller notch 228. Consequently, upon entering the cutting notch 228, baling wire 18*b* urges baling wire 18*a* toward the trailing end 232 of the wire pulling notch 228. Similarly, upon engaging and retaining a third baling wire 18*c* and possible a fourth baling wire 18*d* in wire puller notch 228, baling wire 18*a* is urged closer to the trailing end 232 of the wire puller notch 228. However, the inwardly extending protrusion 238 functions to securely retain all of the baling wires 18*a*–18*d* within the wire pulling notch 228 until such a time as all of the baling wires 18*a*–18*d* have been safely removed from the kraft paper bale 16 and cleared from the path of the conveyor 14.

In summary, a new and improved wire breaker blade member and a new and improved wire puller member for an automatic kraft bale dewire machine are provided. The wire breaker blade of the subject invention includes a hook-shaped cutting notch formed therein that is provided with an inwardly extending protrusion for securely engaging and retaining a plurality of baling wires until fracture occurs. Similarly, the wire puller member of the subject invention is provided with a hook-shaped wire pulling notch having an inwardly extending protrusion for securely engaging and retaining a plurality of baling wires until such a time as the wires are removed from the bale after they have been fractured by the wire breaker blade member.

While the invention has been described with respect to a preferred embodiment, it is apparent that various changes can be made without departing from the scope of the invention. For example, both the wire breaker blade member and the wire puller member may be provided with a plurality of hook-shaped notches disposed in spaced apart relationship.

I claim:

1. A substantially planar generally rectangular elongated breaker blade for an automatic kraft bale dewiring machine in which the breaker blade includes opposed top and bottom edges and opposed front and rear edges and is formed with a mounting portion adjacent the bottom edge thereof and a wire cutting area adjacent the top edge thereof, the wire cutting area being adapted to engage and break a plurality of baling wires wrapped about a bale of kraft paper, and the cutting area including at least one flat surface along the top edge of the breaker blade which extends parallel to the longitudinal axis of the breaker blade, the improvement comprising:

the wire cutting area having at least one wire cutting notch formed therein, the wire cutting notch having an opening along the top edge of the breaker blade and being defined by a forward edge which extends downwardly into the wire cutting area parallel to the opposed front and rear edges of the breaker blade and an arcuate rearward cutting edge which extends circumferentially upwardly from the forward edge of the wire cutting notch to the top edge of the breaker blade forming an inwardly extending protrusion at the opening of the wire cutting notch, the inwardly extending protrusion defining a bale wire retaining means in the wire cutting notch for restraining a plurality of baling wires in the wire cutting notch until fracture of the baling wires occurs.

2. A breaker blade as recited in claim 1 wherein the arcuate rearward cutting edge of the cutting notch extends through an arc of approximately 220°.

3. A breaker blade as recited in claim 1 wherein the maximum longitudinal dimension of the wire cutting notch is greater than the length of the opening of the wire cutting notch along the top edge of the breaker blade.

4. A breaker blade as recited in claim 1 wherein the top edge of the breaker blade includes two flat surfaces which extend parallel to the longitudinal axis of the breaker blade and are respectively disposed on both sides of the cutting notch.

5. A substantially planar generally rectangular wire puller member for an automatic kraft bale dewiring machine in which the wire puller member includes opposed top and bottom edges and opposed front and rear edges and is formed with a mounting portion adjacent the top edge thereof and a wire pulling area adjacent the bottom edge thereof, the wire pulling area being adapted to engage and remove a plurality of baling wires wrapped about a bale of kraft paper, and the improvement comprising:

the wire pulling area having at least one wire pulling notch formed therein, the wire pulling notch having an opening along the bottom edge of the wire puller member and being defined by a forward edge which extends upwardly into the wire pulling area parallel to the opposed front and rear edges of the wire puller member and an arcuate rearward pulling edge which extends circumferentially from the forward edge of the wire pulling notch to the bottom edge of the wire puller member forming an inwardly extending protrusion at the opening of the wire pulling notch, the inwardly extending protrusion defining a bale wire retaining means in the wire pulling notch for restraining a plurality of baling wires in the wire pulling notch until removal of the baling wires from the kraft paper bale is accomplished.

6. A wire puller member as recited in claim 5 wherein said arcuate rearward pulling edge of said wire pulling notch extends through an arc of approximately 225°.

7. A wire puller member as recited in claim 5 wherein the maximum longitudinal dimension of the wire pulling notch is greater than the length of the opening of the wire pulling notch along the bottom edge of the wire puller member.

8. An automatic kraft bale dewiring system for cutting and removing a plurality of baling wires from a bale of kraft paper, the dewiring system including a dewiring machine into which a bale of kraft paper is conveyed, the dewiring machine including a base and a roof and further comprising:

a breaker blade member having a generally rectangular substantially planar blade body including opposed top and bottom edges and opposed front and rear edges, the breaker blade being formed with a mounting portion adjacent the bottom edge thereof for being operably mounted in the base of the dewiring machine and a wire cutting area adjacent the top edge thereof, the wire cutting area having at least one wire cutting notch formed therein the wire cutting notch having an opening along the top edge of the breaker blade and being defined by a forward edge which extends downwardly into the wire cutting area parallel to the opposed front and rear edges of the breaker blade and an arcuate rearward cutting edge which extends circumferentially upwardly from the forward edge of the wire cutting notch to the top edge of the breaker blade forming an inwardly extending protrusion at the opening of the wire cutting notch, the inwardly extending protrusion defining a bale wire retaining means in the wire cutting notch for restraining a plurality of baling wires in the wire cutting notch until fracture of the baling wires occurs; and a wire puller member having a substantially planar generally rectangular puller body including opposed top and bottom edges and opposed front and rear edges, the puller member being formed with a mounting portion adjacent the top edge thereof for operably mounting the wire puller member in the roof of the dewiring machine and a wire pulling area adjacent the bottom edge thereof, the wire pulling area having at least one wire pulling notch formed therein, the wire pulling notch having an opening along the bottom edge of the wire puller member and being defined by a forward edge which extends upwardly into the wire pulling area parallel to the opposed front and rear edges of the wire puller member and an arcuate rearward pulling edge which extends circumferentially downwardly from the forward edge of the wire pulling notch to the bottom edge of the wire puller member forming an inwardly extending protrusion at the opening of the wire pulling notch, the inwardly extending protrusion defining a bale wire retaining means in the wire pulling notch for restraining a plurality of baling wires in the wire pulling notch until removal of the baling wires from the kraft paper bale is accomplished.

* * * * *